US006681933B1

(12) United States Patent
Demsien et al.

(10) Patent No.: US 6,681,933 B1
(45) Date of Patent: Jan. 27, 2004

(54) WRITING UTENSIL CASE

(75) Inventors: Steven H. Demsien, Oregon, WI (US); Brian Brown, Madison, WI (US); Dean Holzberger, Milwaukee, WI (US); Casey Ketterhagen, Milwaukee, WI (US)

(73) Assignee: Berol Corporation, Freeport, IL (US)

( * ) Notice: Subject to any disclaimer, the term of this patent is extended or adjusted under 35 U.S.C. 154(b) by 180 days.

(21) Appl. No.: 09/666,779

(22) Filed: Sep. 21, 2000

(51) Int. Cl.[7] ..... B65D 85/28

(52) U.S. Cl. ..... 206/371; 206/214; 206/443; 206/459.5

(58) Field of Search ..... 206/214, 224, 206/371, 372, 373, 376, 379, 806, 561, 562, 563, 564, 565, 557, 443, 459.5; 211/69, 69.1; 220/503; D19/77, 81, 82, 83, 84, 85

(56) References Cited

U.S. PATENT DOCUMENTS

| | | | | | |
|---|---|---|---|---|---|
| 498,455 | A | * | 5/1893 | Bartlett | 206/443 |
| 3,768,639 | A | * | 10/1973 | Dogliotti | 206/443 |
| 4,076,116 | A | * | 2/1978 | Sowders | 206/486 |
| 4,176,763 | A | | 12/1979 | Klara et al. | |
| 4,449,304 | A | | 5/1984 | Underwood | |
| D277,335 | S | | 1/1985 | Lieberman | |
| 4,815,622 | A | * | 3/1989 | Cramer | 206/443 |
| D315,446 | S | * | 3/1991 | Dietterich et al. | D6/524 |
| 5,005,703 | A | * | 4/1991 | Bodker | 206/563 |
| D320,413 | S | | 10/1991 | Dietterich et al. | |
| 5,103,969 | A | | 4/1992 | Tarozzi | |
| D330,045 | S | | 10/1992 | Dietterich et al. | |
| D331,258 | S | | 11/1992 | Tarozzi | |
| D332,468 | S | | 1/1993 | Tarozzi | |
| D333,487 | S | * | 2/1993 | Papp | D19/75 |
| 5,190,151 | A | | 3/1993 | Dietterich | |
| D334,946 | S | | 4/1993 | Tarozzi | |
| D338,496 | S | | 8/1993 | Tarozzi | |
| 5,248,030 | A | | 9/1993 | Tarozzi | |
| D343,417 | S | | 1/1994 | Tarozzi | |
| D344,975 | S | | 3/1994 | Tarozzi | |
| D345,692 | S | | 4/1994 | Franekic et al. | |
| D351,504 | S | | 10/1994 | Tarozzi | |
| D351,727 | S | | 10/1994 | Tarozzi | |
| D353,840 | S | | 12/1994 | Dietterich et al. | |

(List continued on next page.)

*Primary Examiner*—Shian Luong
(74) *Attorney, Agent, or Firm*—Marshall, Gerstein & Borun LLP

(57) ABSTRACT

A case for holding writing utensils includes a body having an outer surface and a retaining surface. The outer surface of the body is configured for placement on a substantially horizontal surface. The retaining surface has at least one first recess configured to frictionally retain a portion of a writing utensil at a first angle with respect to the horizontal surface such that an end portion of the writing utensil obliquely extends from the retaining surface. The case may include at least one first channel and at least one second channel are defined within the inner surface along first and second gradients, respectively. The first gradient slopes upward from a front end of the first channel to a rear end of the first channel. The second gradient slopes downward from a front end of the second channel to a rear end of the second channel. The first and second channels are each configured to retain a portion of a writing utensil. Each first channel is positioned adjacent to at least one second channel such that the first and second channels form a non-interconnected crisscross pattern. The case may also include means for retaining a plurality of writing utensils coupled to the inner surface of the body. The means for retaining a plurality of writing utensils is configured such that the writing utensils alternatively extend from the inner surface in at least two separate directions.

27 Claims, 4 Drawing Sheets

U.S. PATENT DOCUMENTS

| | | | | | |
|---|---|---|---|---|---|
| D354,311 | S | | 1/1995 | Tarozzi | |
| D354,518 | S | | 1/1995 | Dietterich et al. | |
| 5,388,689 | A | | 2/1995 | Kroop et al. | |
| 5,392,557 | A | * | 2/1995 | Harmon et al. | 206/315.11 |
| D356,334 | S | | 3/1995 | Kroop et al. | |
| D356,823 | S | | 3/1995 | Tarozzi | |
| D356,829 | S | | 3/1995 | Russomano et al. | |
| D360,649 | S | | 7/1995 | Volk et al. | |
| D360,894 | S | | 8/1995 | Volk et al. | |
| 5,441,149 | A | | 8/1995 | Willard et al. | |
| D364,893 | S | | 12/1995 | Willard et al. | |
| 5,533,900 | A | | 7/1996 | Volk | |
| D374,349 | S | | 10/1996 | Cziraky et al. | |
| D374,467 | S | | 10/1996 | Cziraky et al. | |
| D384,501 | S | | 10/1997 | Rosen | |
| 5,676,240 | A | | 10/1997 | Cziraky et al. | |
| D390,357 | S | * | 2/1998 | Rosen | D3/282 |
| D392,463 | S | * | 3/1998 | Grey | D3/319 |
| D399,134 | S | | 10/1998 | Lidle, Jr. | |
| 6,012,786 | A | * | 1/2000 | Dunn | 312/100 |
| 6,021,891 | A | * | 2/2000 | Anderson | 206/214 |
| D438,634 | S | * | 3/2001 | Merry | D24/227 |

* cited by examiner

FIG. 3
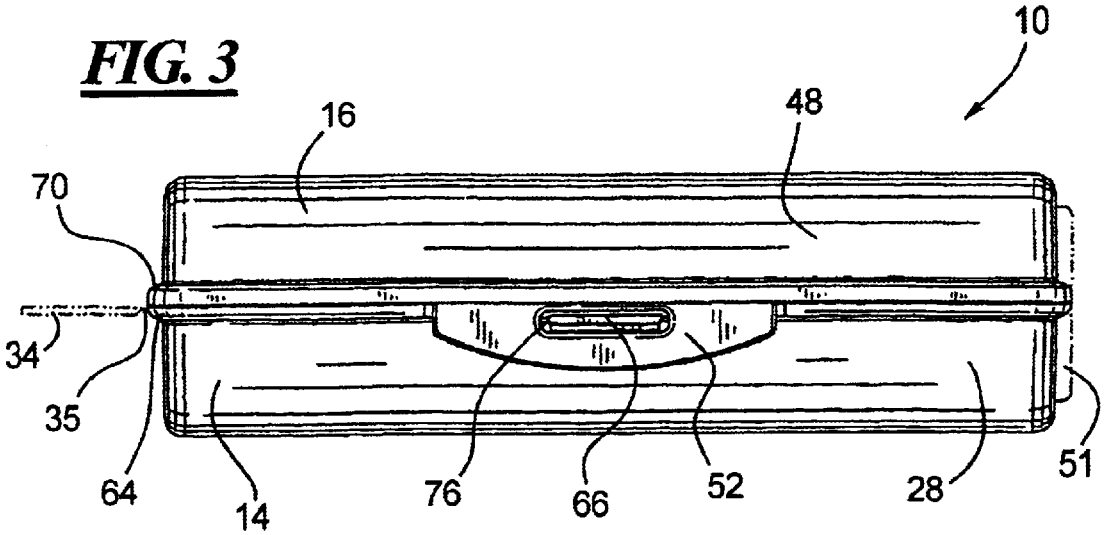
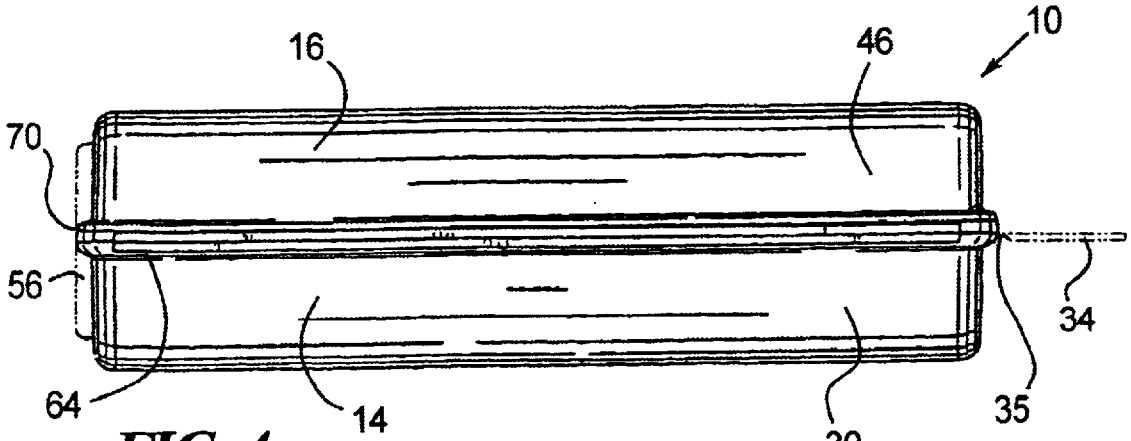
FIG. 4
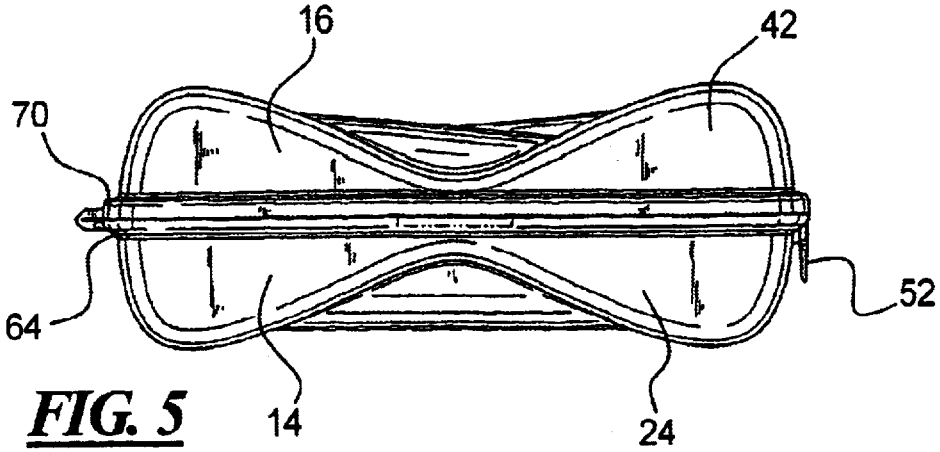
FIG. 5

WRITING UTENSIL CASE

FIELD OF THE INVENTION

The present invention relates generally to the field of containers for holding, storing and transporting objects, and more particularly, a case for holding, storing and transporting writing utensils.

BACKGROUND OF THE INVENTION

Containers for writing utensils typically include a lower body defining a storage space for loosely storing writing utensils and other stationary goods. Containers for writing utensils also typically include lids for covering and enclosing the storage space within the lower body of the container. Other containers for writing utensils include a lower body configured to store and hold a large number of writing utensils arranged adjacent and parallel to one another and along a single plane. Typically, the lower body includes a lower surface configured for placement on to a horizontal surface and the lower body is configured to store and hold the writing utensils along a substantially horizontal plane. These containers typically include lids and the lids can may also be configured to hold writing utensils in a parallel and adjacent relationship to one another. Other containers for writing utensils are configured for placement on to a horizontal surface with the writing utensils positioned adjacent to and parallel to one another along at least one vertical plane. The containers are often made of non-transparent material.

Although such writing utensil containers are commonly used, such containers have several distinct drawbacks. First, the containers often store the writing utensils loosely or only partially restrict the movement of the writing utensils when stored within the container. As a result, during movement or transportation of the container, the writing utensils can become dislodged, mixed together, and damaged as a result of contacting one another during transport, particularly if the container is dropped or turned over. Second, those containers that hold the writing utensils during storage and transportation in a manner that prevents the writing utensils from becoming dislodged and mixed together typically align the writing utensils side by side, in a parallel configuration along a single plane. This closely packed, tightly fit arrangement of the writing utensils makes retrieval of an individual writing utensil from the container difficult, particularly for children, individuals with large fingers or individuals with reduced dexterity. Such arrangements can result in the dislodging of additional, unneeded writing utensils during the removal of the desired writing utensil. This arrangement of writing utensils can also result in damage to adjacent writing utensils due to contact with the individual's fingers during the removal of the desired writing utensil. This closely packed arrangement also increases the likelihood of damage to the container due to the increased propensity for children to drop, shake, or knock the container against a surface in an effort to dislodge the writing utensils. Finally, writing utensils made of non-transparent material require the user to open the container in order to determine the container's contents. This process can be inefficient, time consuming and lead to a reduction in the user's enjoyment of the writing utensil container, particularly in applications where the user requires the use of multiple writing utensils.

Thus, it would be advantageous to provide a container for storing, holding and transporting writing utensils that retains the writing utensils and prevents the writing utensils from becoming dislodged during transportation. What is needed is a container for writing utensils that retains the writing utensils in a configuration that allows a user to easily retrieve an individual writing utensil without dislodging or damaging adjacent or other writing utensils. Additionally, it would be advantageous to provide a writing utensil container that includes a substantially transparent section that allows the user to see the writing utensils within the container without having to open the container.

SUMMARY OF THE INVENTION

According to one exemplary embodiment a case for holding writing utensils includes a body. The body includes an outer surface and a retaining surface. The outer surface of the body is configured for placement on a substantially horizontal surface. The retaining surface has at least one first recess configured to frictionally retain a portion of a writing utensil at a first angle with respect to the horizontal surface such that an end portion of the writing utensil obliquely extends from the retaining surface.

According to another exemplary embodiment a case for holding writing utensils includes a first housing. The first housing includes an outer surface and an inner surface. At least one first channel is defined within the inner surface along a first gradient. The first channel slopes upward from a front end of the first channel to a rear end of the first channel. The first channel is configured to retain a portion of a writing utensil. At least one second channel is defined within the inner surface along a second gradient. The second gradient slopes downward from a front end of the second channel to a rear end of the second channel. The second channel is configured to retain a portion of a writing utensil. Each first channel is positioned adjacent to at least one second channel such that the first and second channels form a non-interconnected crisscross pattern.

According to another exemplary embodiment a case for holding writing utensils includes a body and means for retaining a plurality of writing utensils. The body includes an outer surface and an inner surface. The means for retaining a plurality of writing utensils is coupled to the inner surface of the body. The means for retaining a plurality of writing utensils is configured such that the writing utensils alternatingly extend from the inner surface in at least two separate directions.

BRIEF DESCRIPTION OF THE DRAWINGS

FIG. 3 is a front view of the case of FIG. 2:

FIG. 4 is a rear view of the case of FIG. 2;

FIG. 5 is a left side view of the case of FIG. 2;

DETAILED DESCRIPTION OF THE PREFERRED EMBODIMENTS

Figure 1:
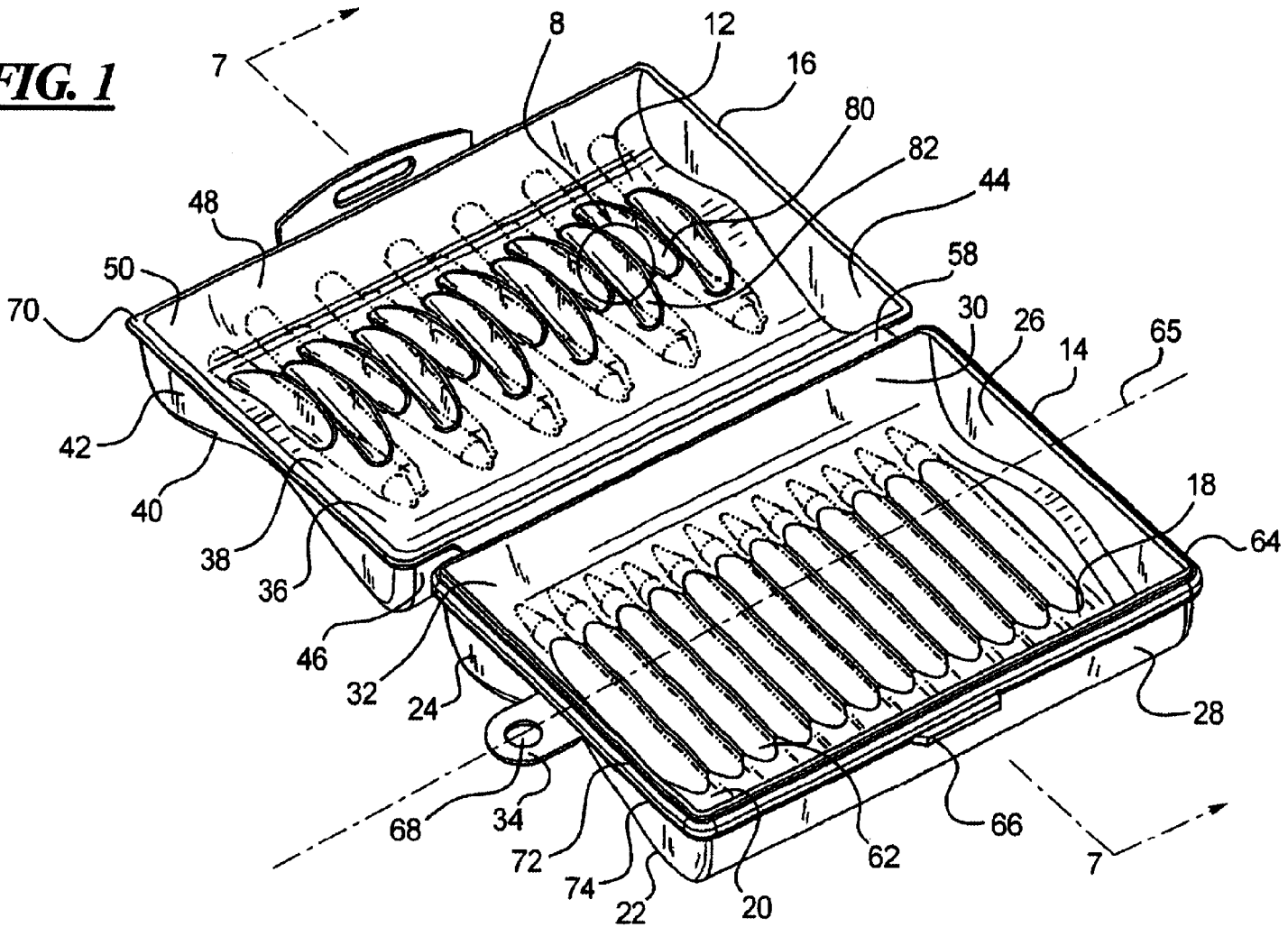
FIG. 1 is a top perspective view of one exemplary embodiment of a case for writing utensils in an open position of the present invention.

FIG. 1 is a top perspective view of a carrying case 10 for writing utensils shown in an open position. In an exemplary embodiment, writing utensils 12 (shown in phantom) are crayons. Alternatively, writing utensils 12 can include markers, pens, pencils, or any combination thereof. Carrying case 10 includes a lower housing 14, an upper housing 16, and a coupling member 58. Lower housing 14 is a generally rectangular structure that is hingeably coupled to upper housing 16. Lower housing 14 is configured to store, hold, transport and display a plurality of writing utensils 12. Lower housing 14 is also configured to hold writing utensils 12 in a side by side arrangement with writing utensils 12 generally positioned within a single plane, parallel to one another. Lower housing 14 is made of translucent polypropylene. Alternatively, lower housing 14 can be made of a non-translucent polypropylene, plastic, cardboard, wood, aluminum, etc. Lower housing 14 provides a light weight, portable, durable and inexpensive structure for holding a plurality of writing utensils 12.

Lower housing 14 includes a generally rectangular lower retaining panel 18 and four interconnected side walls extending from lower retaining panel 18. An outer surface 22 of lower retaining panel 18 is configured for placement on a substantially horizontal surface. The four interconnected side walls include opposing first and second side walls 24, 26 positioned substantially perpendicular to opposing third and fourth side wails 28, 30. Lower retaining panel 18 and side walls 24, 26, 28 and 30 of lower housing 14 define a lower housing storage area 32.

Lower housing 14 further includes a plurality of lower housing channels 62 defined into an inner surface 20 of lower retaining panel 18, a lower housing rim 64, a tongue 66, and a bracket 34. Lower housing channels 62 are positioned side by side. Each lower housing channel 62 transversely extends across a longitudinal axis 65 of lower housing 14. Lower housing channels 62 are configured side by side for holding writing utensils 12 generally along a single plane. In an exemplary embodiment the portion of lower retaining panel 18 defining lower housing channels 62 is made of substantially transparent polypropylene. The transparency of lower retaining panel 18 at lower housing channels 62 allows the user to identify the color of, the number of, and any alphanumeric or graphical indicia placed on writing utensils 12 retained in lower housing 14 of case 10, without having to open carrying case 10. Alternatively, lower housing 14 can be made entirely of transparent or semi-transparent material. In an exemplary embodiment, lower housing 14 includes twelve lower housing channels 62. In an exemplary embodiment, first and second side walls 24, 26 of lower housing 14 have a length of approximately 4.18 inches, third and fourth side walls 28, 30 of lower housing 14 have a length of approximately 5.4 inches, and lower housing 14 has an average depth of approximately 0.75 inches. In exemplary embodiment, lower housing channels 62 are configured to receive writing utensils 12 and to hold a single writing utensil 12 within each lower housing channel 62 when lower housing 14 is placed in a generally horizontal position with inner surface 20 of lower retaining panel 18 facing generally upward. In an alternative exemplary embodiment, when each lower housing channel 62 contains an individual writing utensil, each writing utensil 12 contacts and frictionally engages either two adjacent writing utensils 12 or one writing utensil 12 and one of the first and second side walls 24, 26. The frictional engagement of writing utensils 12 prevents writing utensils 12 from becoming dislodged or dropping out of position during storage or transport. In another alternative exemplary embodiment, each lower housing channel 62 is configured to frictionally retain a single writing utensil 12 such that each writing utensil 12 is retained within lower housing channel 62 during storage or transport.

Lower housing rim 64 outwardly and integrally extends from an outer edge of first, second and fourth side walls 24, 26, 30 of lower housing 14, and outwardly and integrally extends from a portion of third wall 28. Lower housing rim 64 is configured to sealably and releasably engage an upper housing rim 70 of upper housing 16. Lower housing rim 64 includes first and second projections 72, 74. First projection 72 outwardly extends from side walls 24, 26, 28, 30 in a direction substantially perpendicular to lower retaining panel 18. Second projection 74 outwardly extends from side walls 24, 26, 28, 30 in a direction substantially perpendicular to side walls 24, 26, 28, 30.

Tongue 66 is a projection outwardly and integrally extending from a central edge portion of third wall 28 of lower housing 14 in a direction substantially perpendicular to third wall 28. Tongue 66 is configured to releasably engage latch extension 52 of upper housing 16.

Bracket 34 is a generally planar sheet of material integrally formed to and outwardly extending from first side 24 of lower housing 14. Alternatively, bracket 34 can be connected to case 10 with adhesive, fasteners, or other conventional means. Bracket 34 is configured for engaging a supporting device (not shown) for hanging or storing case 10 when not in use. Bracket 34 includes an eyelet 68 for receiving the supporting device. Bracket 34 increases the storage flexibility of carrying case 10 for easy storage within a home, a school, or a business. Alternatively, bracket 34 can be positioned at other locations on case 10.

Upper housing 16 is a generally rectangular structure. Upper housing 16 is hingeably coupled to lower housing 14 with coupling member 58. Upper housing 16 provides a light weight, durable, secure, and inexpensive structure for retaining a plurality of writing utensils 12 in a crisscross pattern such that each individual writing utensil 16 can be readily and easily retrieved by a user. Upper housing 16 retains writing utensils 12 such that an end portion of each writing utensil 12 generally upwardly extends from a generally rectangular retaining panel 36. In an alternative exemplary embodiment, upper housing 16 retains writing utensils 12 such that an end portion of each writing utensil 12 obliquely extends from retaining panel 36. Upper housing 16 is substantially made of a translucent polypropylene. Alternatively, upper housing 16 can be made of a non-translucent polypropylene, plastic, cardboard, wood, aluminum, etc. The crisscross configuration of writing utensils 12 retained within upper housing 16 is especially useful for individuals who may have difficulty removing utensils 16 from a tightly packed writing utensil holder, such as: individuals with developing motor skills, including small children; individuals with large fingers; and individuals with reduced dexterity. Additionally, upper housing 16 retains each writing utensil 12 separately, allowing a user to easily retrieve an individual writing utensil without contacting, dislodging or damaging adjacent writing utensils.

Upper housing 16 includes retaining panel 36 and four interconnected side walls extending from retaining panel 36. An outer surface 40 of retaining panel 36 is configured for placement on a substantially horizontal surface. The four interconnected side walls include opposing first and second side walls 42, 44 positioned substantially perpendicular to opposing third and fourth side walls 46, 48. Retaining panel 36 and side walls 42, 44, 46 and 48 of upper housing 16 define an upper housing storage area 50.

Upper housing 16 further includes a plurality of first and second channels 80, 82 defined within an inner surface 38 of retaining panel 36, an upper housing rim 70, and a latch extension 52. First channels 80 slope downward along a first gradient from third side 46 of upper housing 16 to fourth side 48 of upper housing 16. Conversely, second channels 82 slope upward along a second gradient from third side 46 of upper housing 16 to fourth side 48 of upper housing 16. First and second channels 80, 82 are alternatively aligned along parallel vertically positioned planes, when case 10 is placed on a horizontal surface. The first and second gradients of first and second channels 80, 82, respectively, provide a crisscross pattern to writing utensils 12 engaged within upper housing 16.

The crisscross pattern defined by first and second channels 80, 82 allows for writing utensils 12 retained within upper housing 16, to be readily and easily retrieved by users, particularly, young children with developing motor skills, individuals with large fingers, and individuals with limited dexterity. Upper housing 16 is configured to facilitate the removal of an individual writing utensil 12 without such removal causing adjacent writing utensils 16 to become dislodged or damaged.

In an exemplary embodiment, the portion of retaining panel defining first and second channels 80, 82 is made of transparent polypropylene and comprises transparent portion 54. In an exemplary embodiment, upper housing 16 includes six first channels 80 and six second channels 82 arranged side by side, in alternating order, to provide non-interconnected "crisscross" appearance to writing utensils 12 disposed within first and second channels 80, 82. The channels are non-interconnected in that the channels do not physically intersect each other, but rather provide a crisscross appearance when viewed from the left side or from the right side. In an exemplary embodiment, first and second side walls 42, 44 of upper housing 16 have a length of approximately 4.18 inches, third and fourth side walls 46, 48 have a length of approximately 5.4 inches and upper housing 16 has an average depth of approximately 0.75 inches.

Upper housing rim 70 outwardly and integrally extends from an outer edge of first, second and third side walls 42, 44, 46 of upper housing 16, and outwardly and integrally extends from a portion of fourth side wall 48. Upper housing rim 70 is configured to sealably and releasably receive first projection 72 of lower housing rim 64.

Latch extension 52 extends from fourth side wall 48 of upper housing 16 within the same plane as fourth side wall 48 and away from upper retaining panel 36. Latch extension 52 is configured to releasably engage tongue 66 of 16 lower housing 14 when case 10 is placed into a closed position.

Coupling member 58 is a "living hinge" including an elongated sheet extending substantially along and integrally connected to fourth side 30 of lower housing 14 and third side 46 of upper housing 16. Coupling member 58 allows for the connection of lower housing 14 to upper housing 16 and the repeated pivotable and hingeable movement of upper housing 16 relative to lower housing 14. Coupling member 58 is made of polypropylene. Alternatively, coupling member 58 can be made of other materials, such as cardboard, metal, etc. Alternatively, coupling member 58 can be attached to lower housing 14 and upper housing 16 via adhesives, fasteners, or other conventional means.

Figure 2:
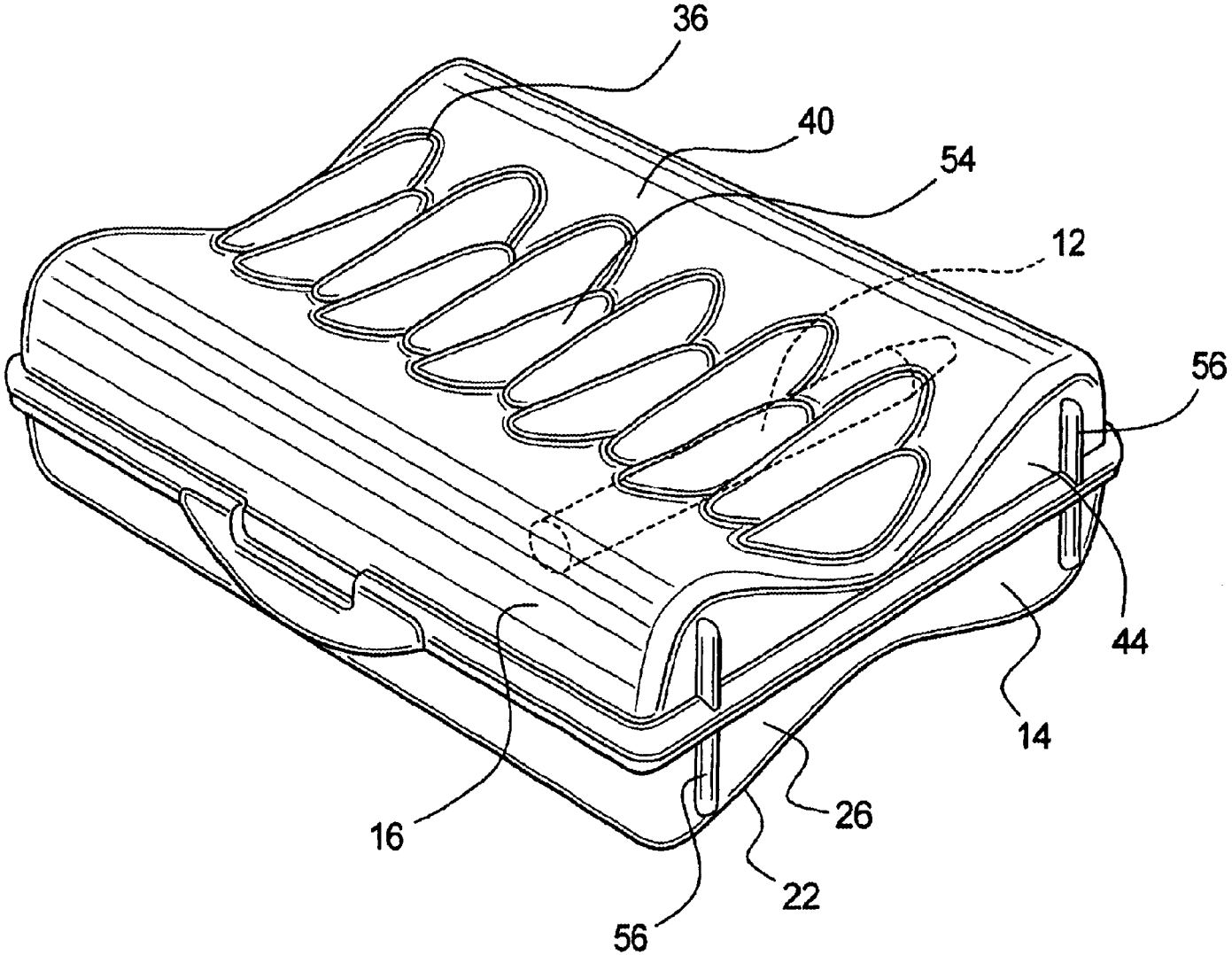
FIG. 2 is top perspective view of the case of FIG. 1 in a closed position.

FIG. 2 is a top perspective view of carrying case 10 shown in a closed position with upper housing 16 positioned over lower housing 14. Case 10 includes a pair of projections 56 outwardly and integrally extending from second side 26 of lower housing 14 and from second side 44 of upper housing 16. Projections 56 provide a support surface for supporting carrying case 10 in an upright position. Projections 56 are made of polypropylene. Alternatively, projections 56 can be made of cardboard, wood, metal, etc. Alternatively, projections 56 may be removably connected to second sides 26, 44 of carrying case 10.

FIG. 2 illustrates upper and lower housings 16, 14 in further detail. Upper housing 16 further includes a substantially transparent portion 54 formed into retaining panel 36. Transparent portion 54 of retaining panel 36 is a centrally positioned section extending along a longitudinal axis of upper housing 16. Transparent portion 54 is integrally formed to the translucent portions of upper housing 16. Transparent portion 54 allows the user to identify the color of, the number of, and any alphanumeric or graphical indicia placed on writing utensils 12 retained in upper housing 16 of case 10, without having to open carrying case 10. Alternatively, upper housing 16 can be made entirely of transparent or semi-transparent material.

FIG. 3 illustrates latch extension 52 and tongue 66 in greater detail. Latch extension 52 is a generally planar member having a groove 76. Latch extension 52 outwardly and integrally extends from and within the same plane as fourth side wall 48 of upper housing 16. Latch extension 52 is configured to releasably engage tongue 66 at groove 76. Latch extension 52 and tongue 66 are made of a resilient material such as polypropylene. Alternatively, latch extension 52, or tongue 66 can be made of other materials, such as plastic, aluminum, cardboard, etc. In an alternative exemplary embodiment, latch extension 52 can be located on lower housing 14 and tongue 66 can be located on upper housing 16. In alternative embodiments, other latch mechanisms can be employed such as straps, snaps, clips, hook and loop type fasteners, etc.

FIGS. 3 and 4 illustrate bracket 34 and rims 64, 70 in greater detail. Bracket 34 includes a slit 35 extending across bracket 34 transverse to longitudinal axis 65. Slit 35 provides a cutting line for guiding a cutting device (not shown), such as a pair of conventional scissors, for the easy removal of bracket 34 from lower housing 14. Slit 35 provides the user with the flexibility of retaining bracket 34 for hanging case 10 when not in use or easily removing bracket 34 by cutting along slit 35. In an exemplary embodiment, bracket 34 further includes an indication, such as an impression of an open pair of conventional scissors, indicating that bracket 34 can be easily removed by cutting bracket 34 along slit 35.

Upper housing rim 70 releasably and sealably engages lower housing rim 64, when case 10 is in a closed position. Upper housing rim 70 extends over and outside of lower housing rim 64. The engagement of upper and lower housing rims 70, 64 seals case 10 thereby preventing moisture or debris outside the case 10 from entering case 10.

Figure 6:
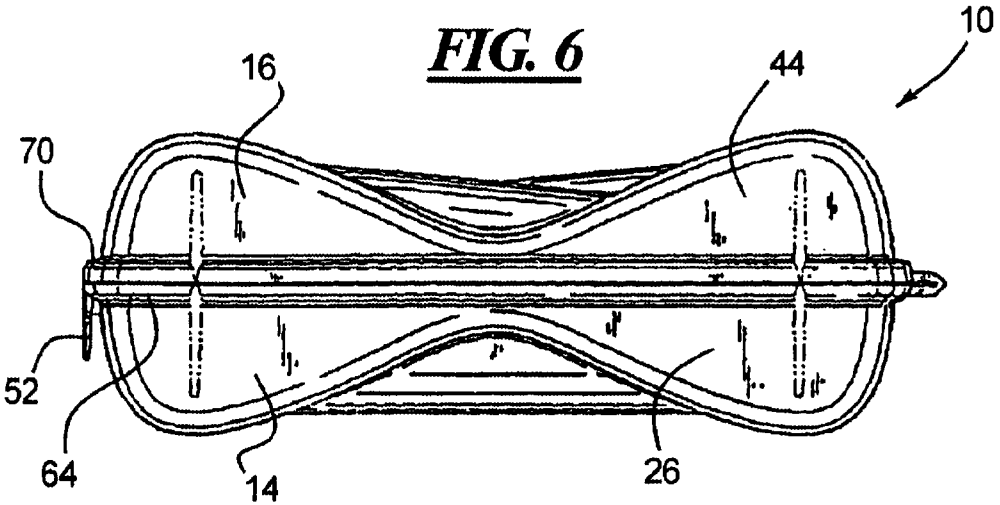
FIG. 6 is a right side view of the case of FIG. 2.

FIGS. 5 and 6 illustrate case 10 in greater detail. FIGS. 5 and 6 illustrate the general "hour glass" profile of case 10. The general "hour glass" shape of case 10 facilitates grasping and transporting of case 10 with one hand. In an exemplary embodiment, case 10 can be configured with a textured outer surface to further facilitate grasping of case 10 by the user. Additionally, in an exemplary embodiment, case 10 is configured to maximize the placement and storage options available to the user. Carrying case 10 can be securely positioned with outer surface 22, 40 of one or both of lower and upper housings 14, 16, depending on whether case 10 is in an open or a closed position, on a substantially horizontal surface. Additionally, carrying case 10 can be positioned in a substantially upright position with case 10 resting on projections 56 extending from second sides 26, 44 of upper and lower housings 16, 14, respectively. Alternatively, case 10 can be suspended from bracket 34 (shown on FIG. 1).

Figure 7:
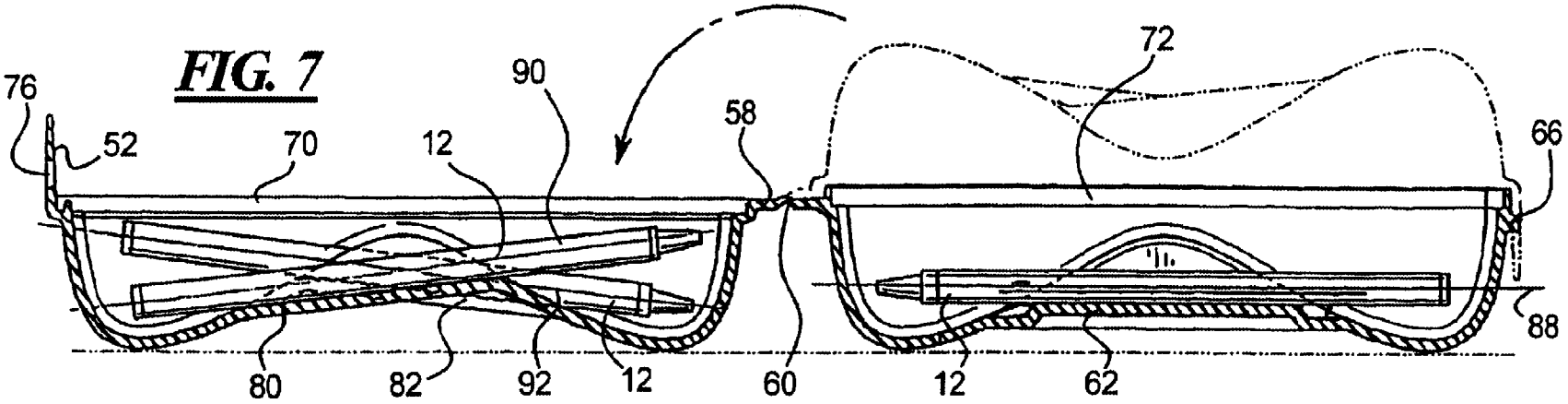
FIG. 7 is a cross-sectional side view of the case of FIG. 1 taken along lines 7—7.

FIG. 7 illustrates case including lower housing channel 62, first and second channels 80, 82 of upper housing 16, and coupling member 58 in greater detail. Writing utensils 12 disposed within lower housing channels 62 lie in a plane generally indicated at 88. When case is in an open position on a horizontal surface, as shown in FIG. 7, plane 88 is positioned parallel to the horizontal surface. Writing utensils 12 disposed within first channels 80 lie in a plane generally indicated at 90 and which writing utensils 12 disposed within second channels 82 lie in a plane generally indicated at 92. Planes 90 and 92 illustrate the crisscross pattern of writing utensils 12 obtained by placement of writing utensils 12 within upper housing 16. The crisscross pattern defined by first and second channels 80, 82 allows for writing utensils 12 retained within upper housing 16, to be readily and easily retrieved by users, particularly, young children with developing motor skills, individuals with large fingers, and individuals with limited dexterity.

Coupling member 58 connects upper and lower housings 16, 14, and includes a longitudinally extending notch 60. Coupling member 58 pivots along notch 60.

Figure 8:
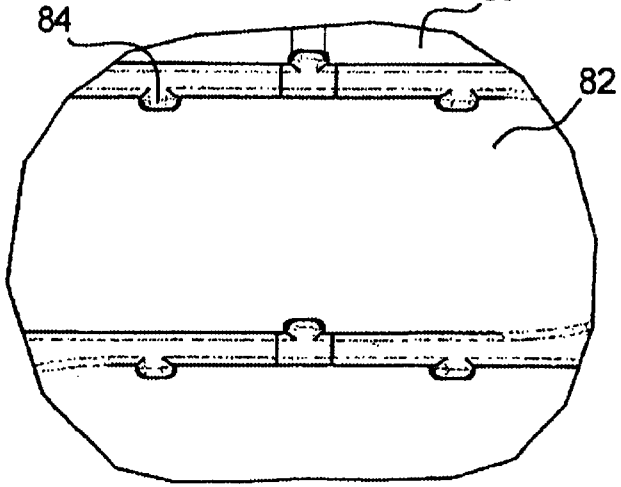
FIG. 8 is a detail view of the receiving surface of the case of FIG. 1 at arrow 8.

FIG. 8 illustrates first and second channels 80, 82 in greater detail. Each channel 80, 82 includes three inwardly extending tabs 84. Tabs 84 are spaced apart with two tabs extending toward second side wall 44 of upper housing 16 and one tab extending toward first side wall 42 of upper housing 16. Tabs 84 are configured to frictionally engage and retain individual writing utensils 12 within each first and second channel 80, 82 during use, storage and transport. The frictional engagement of tabs 84 to each writing utensil 12 allows a user to easily remove writing utensil 12 when desired without dislodging or damaging adjacent writing utensils 12. In an exemplary embodiment, the width of each first and second channel 80, 82 between tabs 84 positioned on opposite sides of each channel is approximately 0.32 inches.

It should be understood that the foregoing description is of preferred exemplary embodiments of this invention, and that the invention is not limited to the specific forms shown. For example, upper housing 16 can be configured to hold writing utensils 12 in a manner similar to lower housing 14 and vice versa. Additionally, upper housing 16 or lower housing 14 can be configured as a lid. Further modifications may be made in the design, arrangement and combination of the elements without departing from the scope of the invention as expressed in the appended claims.

What is claimed is:

1. A case for holding writing utensils comprising:

a body including an outer surface and a retaining surface, the outer surface of the body configured for placement on a substantially horizontal surface, the retaining surface having at least one first recess at a first angle and configured to frictionally retain a portion of a writing utensil at the first angle such that an end portion of the writing utensil obliquely extends from the retaining surface and a portion of the writing utensil is closely adjacent to the bottom;

wherein the retaining surface has at least one second recess at a second angle and configured to frictionally retain a portion of a writing utensil at the second angle, and the second angle is not equal to the first angle;

wherein the at least one first recess is positioned adjacent to the at least one second recess such that a first plane vertically extending through a longitudinal axis of the first recess is substantially parallel to a second plane vertically extending through a longitudinal axis of the second recess, when the outer surface of the body is placed on a substantially horizontal surface; and wherein the first recess and the second recess include an engagement surface for frictionally retaining a portion of a writing utensil along a first axis having the first angle and a second axis having the second angle, wherein the engagement surfaces at least partially overlap along an axis perpendicular to the first and second axis.

2. The case of claim 1, wherein a plurality of first and second recesses are alternately positioned with respect to one another.

3. The case of claim 1, wherein each of the first and second recesses includes at least two tabs for frictionally engaging the portion of the writing utensil.

4. The case of claim 1, wherein the first and second recess are configured to retain a writing utensil selected from the group consisting of crayons, pencils, pens, markers and a combination thereof.

5. The case of claim 1, further comprising a lid configured to substantially cover the retaining surface of the body.

6. The case of claim 5, wherein the lid is configured to hold a plurality of the writing utensils.

7. The case of claim 6, wherein the lid is pivotally coupled to the body.

8. The case of claim 7, wherein the case is configured to be positioned in at least two positions, a first position, in which the outer surface of the body and an outer surface of the lid are positioned for placement on a substantially horizontal plane, and a second position, in which the body is disposed over the lid such that the retaining surface of the body and a retaining surface of the lid face one another.

9. The case of claim 7, further including a latch mechanism coupled to at least one of the body and the body to the lid.

10. The case of claim 1, wherein the body is made of resilient material and wherein a portion of the body is transparent.

11. The case of claim 1, further comprising a protrusion including a catch for hanging the case.

12. A case for holding writing utensils comprising:

a first housing including an outer surface and an inner surface, wherein the first housing is made of resilient material; and at least one first channel and at least one second channel defined within the inner surface along a first angle and a second angle, respectively, the first angle sloping upward from a front end of the first channel to a rear end of the first channel, the second angle sloping downward from a front end of the second channel to a rear end of the second channel, the first and second channels each configured to retain a portion of a writing utensil, the first and second channels being open on each end such that a writing utensil retained therein can extend out each end of the channel, each first channel positioned adjacent to at least one second channel such that the first and second channels form a non-interconnected crisscross pattern.

13. The case of claim 12, further comprising a second housing configured to substantially cover the inner surface of the first housing.

14. The case of claim 13, wherein the second housing is configured to retain a plurality of the writing utensils.

15. The case of claim 13, wherein the second housing is pivotally coupled to the first housing.

16. The case of claim 15, further comprising a latching mechanism coupled to at least one of the first and second housings for releasably coupling the first housing to the second housing.

17. The case of claim 15, wherein the first and second housings when positioned in a closed position, form a general "hour glass" profile which facilitates grasping of the case by a user.

18. The case of claim 12, wherein at least two tabs extend into each of the first and second channels for frictionally engaging a writing utensil.

19. The case of claim 12, wherein the housing is made of substantially transparent material at the first and second channels.

20. The case of claim 12, wherein a plurality of the first and second channels are alternately positioned with respect to one another.

21. The case of claim 12, wherein each channel has a width of about 0.32 inches.

22. A case for holding writing utensils comprising:

a body including an interior cavity;

a first retaining surface;

a second retaining surface;

wherein the first and second retaining surfaces are formed adjacent the interior cavity, the first retaining surface including at least a first engagement surface and a second engagement surface configured to frictionally engage a first and second writing utensil so as to retain the first and second writing utensil along a first and second axis at a first and second angle, respectively; and wherein the first engagement surface and the second engagment surface at least partially overlap one another in a direction perpendicular to the first and second axes.

23. The case of claim 22, wherein the first axis and the second axis are adjacent one another.

24. The case of claim 22, wherein the first axis and second axis are displaced from one another.

25. A combination of a case and writing utensils comprising:

a body including an interior cavity;

a first retaining surface;

a second retaining surface; and a plurality of writing utensils, including a first writing utensil and a second writing utensil;

wherein the first and second retaining surfaces are formed adjacent the interior cavity and include at least one engagement surface configured to frictionally engage the first writing utensil and the second writing utensil so as to retain the first and second writing utensils along a first axis and a second axis at a first angle and a second angle, respectively; and wherein at least two engagement surfaces at least partially overlap one another in a direction perpendicular to the first and second axes.

26. The combination of claim 25, wherein the writing utensils are selected from a group consisting of crayons, pencils, pens, markers and a combination thereof.

27. The case of claim 25, wherein the at least one engagement surface of the first retaining surface includes a channel with a width of about 0.32 inches.

* * * * *

UNITED STATES PATENT AND TRADEMARK OFFICE

CERTIFICATE OF CORRECTION

PATENT NO. : 6,681,933 B1
DATED : January 27, 2004
INVENTOR(S) : Steven H. Demsien et al.

It is certified that error appears in the above-identified patent and that said Letters Patent is hereby corrected as shown below:

Column 8,
Lines 36-37, please delete "and the body to the lid." and insert -- and the lid for releasably coupling the body to the lid. --

Signed and Sealed this

Eleventh Day of May, 2004

JON W. DUDAS
*Acting Director of the United States Patent and Trademark Office*